US009279282B2

(12) United States Patent
Koed

(10) Patent No.: US 9,279,282 B2
(45) Date of Patent: Mar. 8, 2016

(54) FRAME FOR A WINDOW AND A METHOD FOR MAKING A FRAME

(71) Applicant: VKR HOLDING A/S, Hørsholm (DK)

(72) Inventor: Iver Koed, Hørsholm (DK)

(73) Assignee: VKR HOLDING A/S, Horsholm (DK)

( * ) Notice: Subject to any disclaimer, the term of this patent is extended or adjusted under 35 U.S.C. 154(b) by 0 days.

(21) Appl. No.: 14/349,615

(22) PCT Filed: Oct. 4, 2012

(86) PCT No.: PCT/DK2012/050374

§ 371 (c)(1),
(2) Date: Apr. 3, 2014

(87) PCT Pub. No.: WO2013/050042

PCT Pub. Date: Apr. 11, 2013

(65) Prior Publication Data

US 2014/0259942 A1 Sep. 18, 2014

(30) Foreign Application Priority Data

Oct. 4, 2011 (DK) ..... 2011 70556

(51) Int. Cl.

| | |
|---|---|
| ***E05D 15/00*** | (2006.01) |
| ***E06B 3/38*** | (2006.01) |
| ***E04D 13/035*** | (2006.01) |
| ***E06B 7/16*** | (2006.01) |
| ***E06B 1/36*** | (2006.01) |

(Continued)

(52) U.S. Cl.

CPC ..... *E06B 3/38* (2013.01); *E04D 13/0354* (2013.01); *E06B 1/36* (2013.01); *E06B 3/277* (2013.01); *E06B 3/341* (2013.01); *E06B 7/16* (2013.01); *E06B 2003/26332* (2013.01); *E06B 2003/403* (2013.01); *Y10T 29/49826* (2015.01)

(58) Field of Classification Search

CPC ..... E06B 3/38; E06B 3/341; E06B 3/377; E06B 1/36; E06B 7/16

USPC ..... 49/388, 390, 391, 392, 393

See application file for complete search history.

(56) References Cited

U.S. PATENT DOCUMENTS 429,796 A * 6/1890 Rieffel ..... 49/393
1,793,058 A * 2/1931 Chamberlin ..... 49/393

(Continued)

FOREIGN PATENT DOCUMENTS

DE 1242122 B 6/1967
DE 102004042967 A1 3/2006

(Continued)

*Primary Examiner* — Jerry Redman

(74) *Attorney, Agent, or Firm* — Timothy D. St. Clair; Nexsen Pruet, LLC

(57) ABSTRACT

A frame for a window intended to serve either as a stationary frame or as a sash frame according to the invention comprises an insulating abutment list on a side surface of at least one of the top, bottom or side members intended to face a side surface of another frame of the window. The insulating abutment list is made from a material having a thermal conductivity of less than 0.08 W/(m·k), preferably less than 0.04 W/(m·K). Preferred materials for the insulating abutment list are expanded polystyrene (EPS) or extruded polystyrene (XPS). In a window with such a frame, an insulating abutment list on the sash frame preferably extends from hinge part to the bottom member of the sash frame and an insulating abutment list on the stationary frame preferably extends from a hinge part to the top member of the stationary frame.

16 Claims, 7 Drawing Sheets

(51) Int. Cl.

| | |
|---|---|
| ***E06B 3/277*** | (2006.01) |
| ***E06B 3/34*** | (2006.01) |
| *E06B 3/263* | (2006.01) |
| *E06B 3/40* | (2006.01) |

(56) References Cited

U.S. PATENT DOCUMENTS

| | | | | | |
|---|---|---|---|---|---|
| 1,826,678 | A | * | 10/1931 | Sheard | 160/94 |
| 2,750,015 | A | * | 6/1956 | Hauck | 49/392 |
| 2,811,754 | A | * | 11/1957 | Toth | 49/316 |
| 3,003,201 | A | * | 10/1961 | Moreno | 49/393 |
| 3,012,642 | A | * | 12/1961 | Emmerich | 52/204.597 |
| 3,357,136 | A | * | 12/1967 | Marantier | 49/392 |
| 4,156,988 | A | * | 6/1979 | Grover et al. | 49/390 |
| 5,083,398 | A | * | 1/1992 | Kolbeck et al. | 49/395 |
| 6,986,225 | B2 | * | 1/2006 | Gjersoe et al. | 49/388 |
| 2010/0064607 | A1 | * | 3/2010 | Warunek | 52/213 |

FOREIGN PATENT DOCUMENTS

| | | | |
|---|---|---|---|
| DE | 202008013985 | U1 | 2/2009 |
| FR | 2082869 | | 11/1971 |
| GB | 1074095 | | 6/1967 |
| GB | 2010088904 | A1 | 8/2010 |
| NL | 47598 | C | 8/1939 |
| NL | 7412704 | A1 | 4/1975 |

* cited by examiner

FRAME FOR A WINDOW AND A METHOD FOR MAKING A FRAME

BACKGROUND OF THE INVENTION

The present invention relates to a frame for a window, said frame being intended to serve either as a stationary frame or as a sash frame and comprising a top member, a bottom ember and two side members, each having a side surface intended to face a corresponding side surface of another frame of the window. It further relates to a window with such a frame and to a method of making a frame.

In this, whenever the term "frame" is used it is to be understood as including both sash frames carrying panes and stationary frames carrying sash frames. The terms "sash frame" and "stationary frame" are used when reference is made specifically to frames intended for one of these two purposes.

Frames for windows are traditionally made from wooden members, from moulded polyurethane members with a wooden core for reinforcement or from extruded members of aluminum or polyvinylchloride. Different components such as hinges, locking assemblies and gaskets are added to provide the needed functionality and when using extruded profiles, insulation material may be provided in hollows in the profile.

With these ways of making a frame, a limit on the thermal properties seems to have been reached, but the demand for still more energy efficient windows keeps rising.

BRIEF SUMMARY OF THE INVENTION

It is therefore the object of the present invention to provide an alternative frame for a window and a method for making such a frame, which allows the construction of windows having even better thermal properties.

This is achieved with a frame, where at least one of the top, bottom or side members comprises an insulating abutment list on the side surface intended to face a corresponding side surface of another frame of the window, said insulating abutment list being made from a material having a thermal conductivity of less than 0.08 W/(m·K), preferably less than 0.04 W/(m·K).

Abutment lists are used where the sash frame comes into contact with the stationary frame during opening and closing of the window and closes the gap between the sash frame and the stationary frame formed to make room for hinges. For a centre-hung pivot window abutment lists are usually found at the lowermost half of the side members of the stationary frame and at the uppermost half of the side members of the sash frame. The abutment lists have hitherto been integrated in the frame member or made from the same material as a main body of the frame member, but now contributes to the insulation of the window.

It is noted that the terra pivot hinge is intended to cover hinges of the type originally described in DK70390 and the term pivot window to cover windows with this type of hinges, i.e. windows where the hinges are located between the side members of the sash frame and the stationary frame and where the axis of rotation is located at a distance from the plane of the frames.

The desired thermal conductivity may be achieved with numerous materials, including balsa wood, but polymers are presently preferred. Expanded polystyrene (EPS) or extruded polystyrene (XPS) is particularly well-suited since these materials are well tested, relatively cheap, non-toxic and durable.

The insulating abutment lists preferably cover the side surfaces of the parts of the side members extending from a hinge axis to the bottom or top member substantially entirely. This continuity provides for an uninterrupted surface, which makes it durable and easy to keep clean, but it is also possible to use discrete blocks of material. A continuous embodiment, however, allows the insulating abutment list to contribute to the tightening of the window and gives better insulating properties. Moreover, an abutment list on the stationary frame will also be visible from the inside, when the window is open, and a continuous surface is perceived as visually more appealing by most users.

The best possible continuity of the insulating abutment list is achieved when recesses are formed at the ends nearest to the hinge parts in the mounted state, said recesses conforming in shape to the shape of the hinge parts.

To improve the insulating properties even further it may be advantageous to use insulating abutments lists, which also cover at least a part of the exterior side of the frame members, i.e. the side intended to face the exterior of a building in the mounted state of the window.

Likewise it is noted that the frame member carrying the insulating abutment list may itself include insulating material, which may for example be provided in the interior of the frame member, and that the window may be arranged in one or more insulating frames during mounting in a load-bearing structure, such as a roof.

Insulating abutment lists may be attached to the main bodies of the frame members in any appropriate way including the use of screws, glue and/or an adhesive. The attachment must of course be sufficient to keep the insulating abutment list in place during use of the window, but it may be detachable to allow replacement of the insulating abutment list.

DESCRIPTION OF THE DRAWINGS

The invention will be explained in more detail below by means of non-limiting examples and with reference to the schematic drawing, in which.

DETAILED DESCRIPTION OF THE INVENTION

Figure 1:
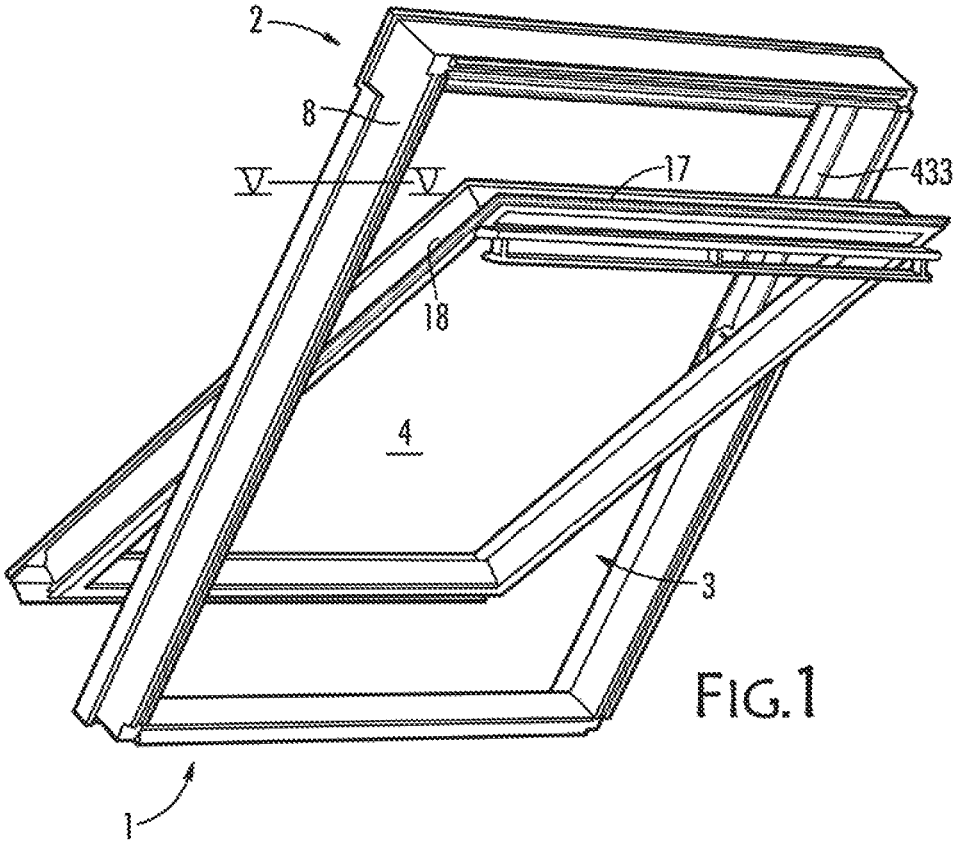
FIG. 1 shows a perspective view of a window according to the invention in the assembled state seen from the interior.
Figure 2:
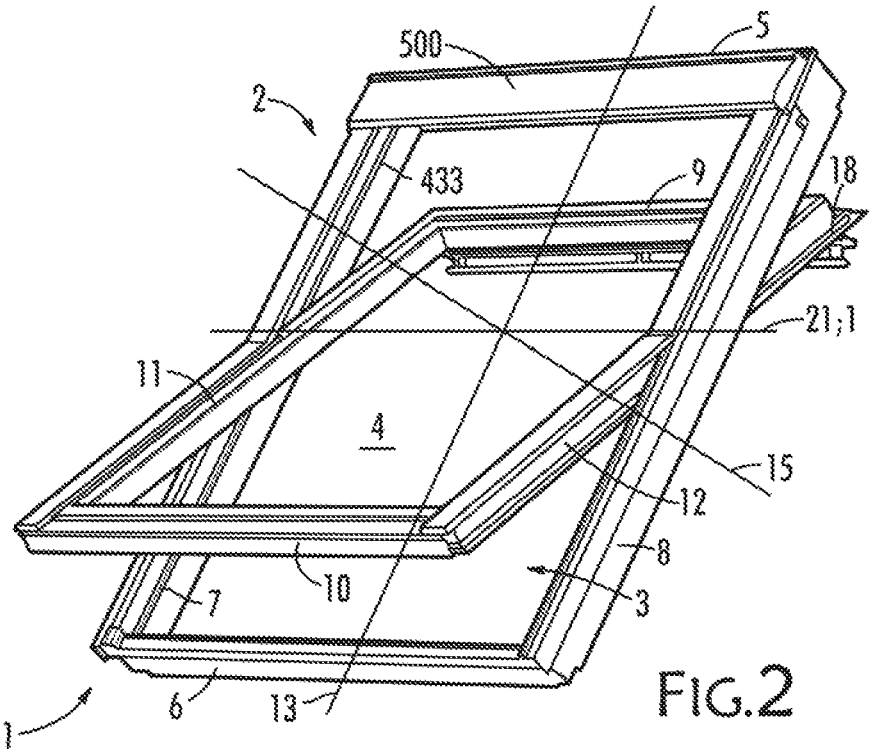
FIG. 2 shows a perspective view of a window according to the invention in the assembled state seen from the exterior.

FIGS. 1 and 2 show a preferred embodiment of a window 1 according to the invention comprising a pane 4, a stationary frame 2 having a top member 5, a bottom member 6 and two side members 7, 8 defining a stationary frame plane, and a sash frame 3 having a top member 9, a bottom member 10 and two side members 11, 12 defining a sash frame plane. In the embodiment shown, the window is centre-hung in that the sash frame 3 is connected to the stationary frame 2 by a pivot hinge 19, 20 (see FIGS. 3 and 4) provided between side members 7, 11; 8, 12 of the stationary frame 2 and sash frame 3, respectively. The window is openable by tilting the sash frame 3 of the window 1 about the pivot hinge axis 21 defined by the pivot hinge. The pivot hinge comprises two parts, namely a stationary frame part 19 and a sash frame part 20.

The hinges used are preferably of the type described in the applicant's earlier patent applications W09928581 and GB1 028251, where a curved member and a tap on one hinge parts 20 travels in a curved guide track in the other 19 during opening and closing of the window. The radius of curvature entails that when using such hinges, the hinge axis lies at a small distance above the actual hinge parts and as the sash frame is turned first the curved member and then the tap comes out of the track. In combination this provides a pattern of movement which allows easy operation of a centre-hung window and allows the sash frame to be turned substantially entirely around.

As used in this description, a closed position of the window 1 means a position in which the stationary frame plane and the sash frame plane coincide, that is form an angle of 0 degrees with each other. Similarly an open position of the window 1 as used herein generally means a position in which the sash frame 3 is tilted about the pivot hinge axis 21 such that the stationary frame plane and the sash frame plane no longer coincide.

As seen in FIG. 1 a longitudinal axis 13 of the window 1 is defined as extending perpendicular to and between the stationary frame top member 5 and the stationary frame bottom member 6, a transversal axis 14 of the window is defined as extending perpendicular to and between the respective stationary frame side members 7 and 8 and thereby perpendicular to the longitudinal axis 13 and a depth axis 15 of the window 1 is defined as extending perpendicular to both the longitudinal axis 13 and the transversal axis 14. The pivot hinge axis 21 and the transversal axis 14 are parallel, and are shown as coinciding in the figures.

The window 1 furthermore comprises a locking assembly 17 of a type known per se for locking the stationary frame 2 and sash frame 3 to each other as well as a generally circumferentially extending sealing 18 provided on the sash frame 3 for sealing the gap between the sash frame 3 and the stationary frame 2 in the closed position of the window 1. The sealing 18 comprises at least one, preferably at least two sealing strips.

Notwithstanding the centre-hung window 1 shown in FIG. 1 the window according to the invention may in other embodiments be top-hung, with or without an intermediate frame structure, have the hinge axis somewhere between the top and the centre, be side-hung or for that matter even be bottom-hung.

The sash frame 3 and stationary frame 2 of the window according to the invention may for example be made of wooden members or members made of cast or extruded polyurethane (PUR).

Figure 3:
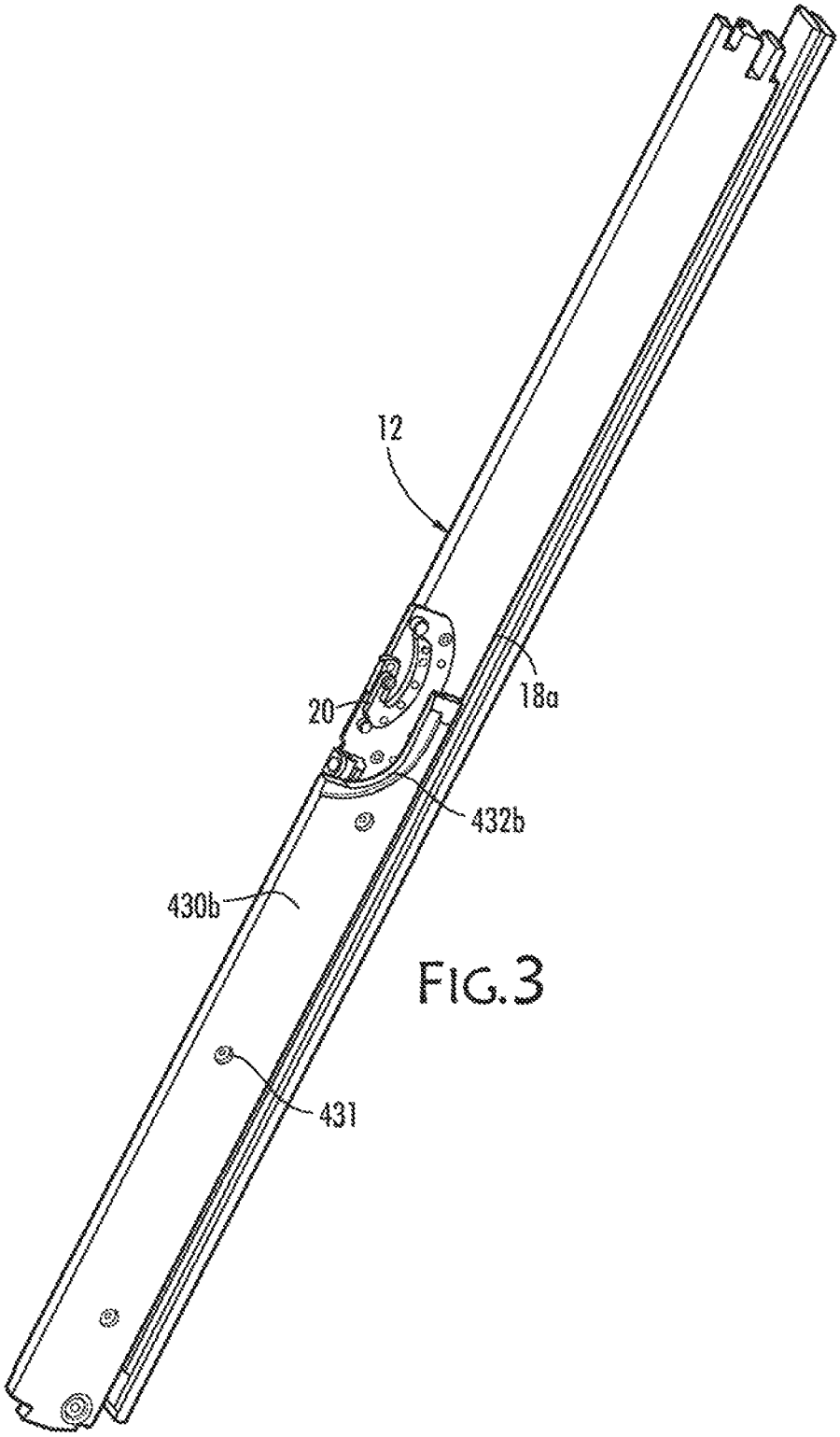
FIG. 3 shows a side sash frame ember in a perspective view.
Figure 4:
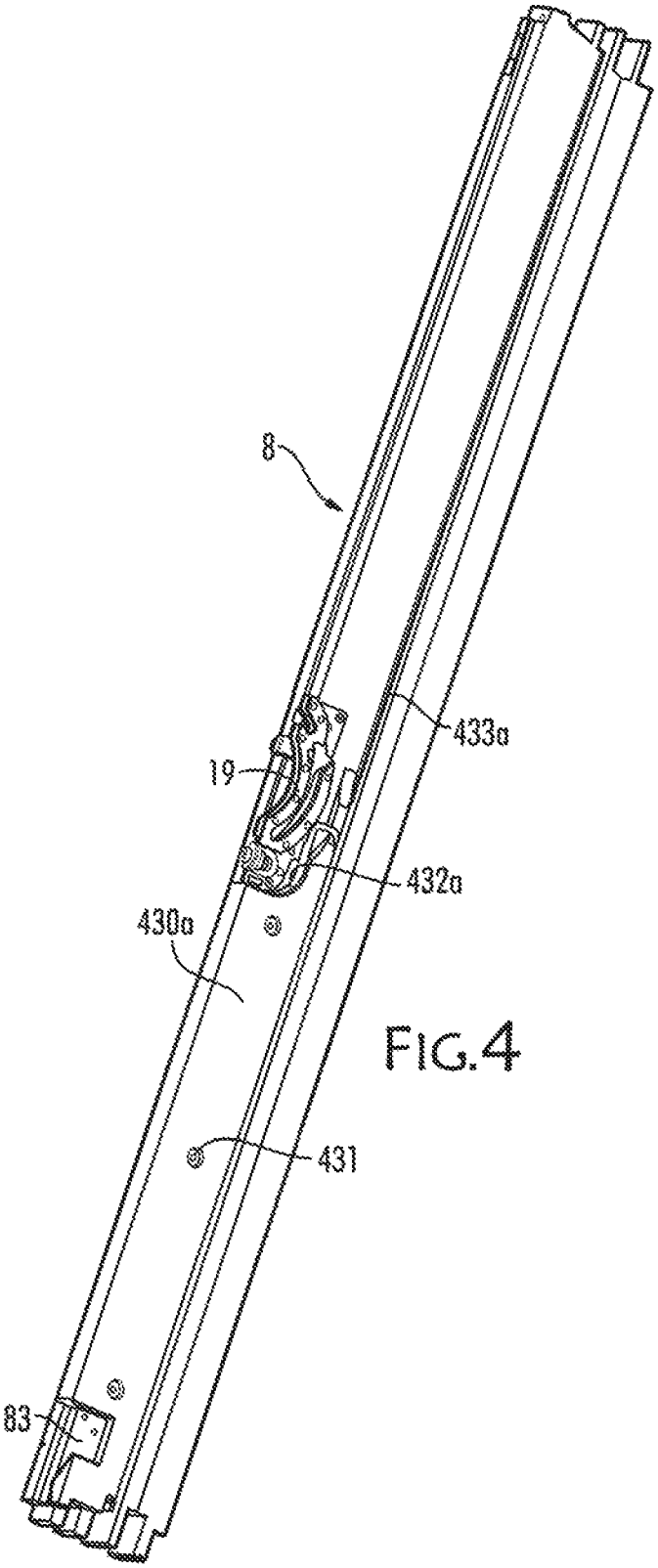
FIG. 4 shows a stationary side frame member in a perspective view.

Referring now to FIGS. 3 and 4, the window 1 further comprises at least one insulating abutment list 430*a*, 430*b*. Here an insulating abutment list is provided on both of the opposing side members 8 and 12 of the sash frame and stationary frame respectively and each extending over approximately half the length of the side frame member. It is, however, also possible, though less preferred, to use an insulating abutment list only on one of the frame side members, possibly extending over its entire length.

Seen in the height direction, the insulating abutment lists 430*a*, 430*b* of this preferred embodiment covers the side frame members 8, 12 down to the sealing strip 18, 433, which is arranged in a groove 18*a*, 433*a* in the main body of the side frame member. It is, however, also possible to use an insulating abutment list covering a bigger part of the side member, possibly the entire height, and the sealing strip 18, 433 may then shed attached to or integrated in the insulating abutment list. In this embodiment, each frame comprises only a single sealing strip, but particularly the stationary frame may advantageously comprise two sealing strips arranged one above the other.

Figure 5:
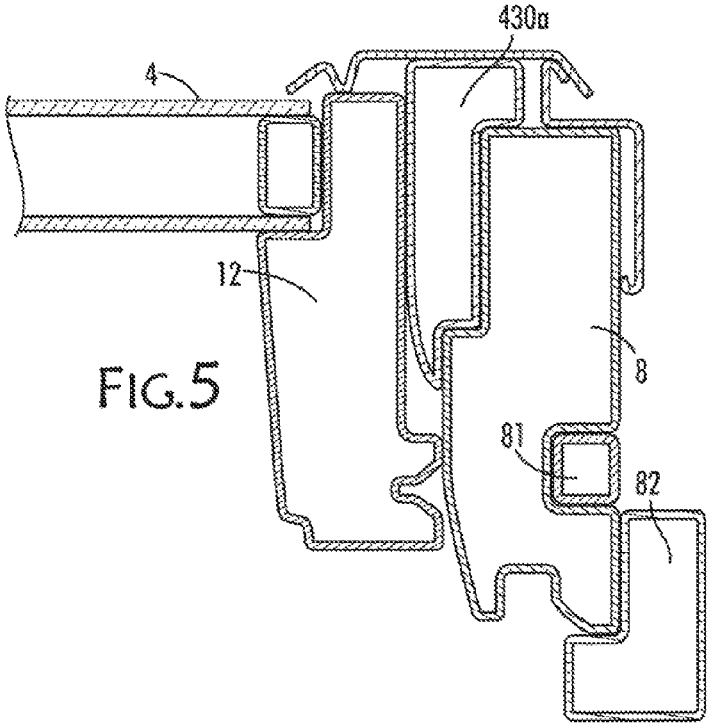
FIG. 5 shows a sketch of a cross-section along the line V-V in FIG. 1 in the closed and mounted state of the window.

For optimal insulation the insulating abutment lists preferably also covers at least a part of the exterior surface of the frame member, i.e. the side intended to face the exterior of a building in the mounted state of the window as may be seen most clearly in FIG. 5, but is also shown in FIG. 4. Here the insulating abutment list covers only a part of the exterior surface of the frame member and in FIG. 4 a recess 83 is provided for receiving the part of the list projecting over the exterior side, but it may also cover a larger part or even the entire exterior surface. Likewise, the insulating abutment list may project over the exterior side in the height direction as in FIGS. 3 and 5. The design of the abutment list should, however, be made in accordance with the design of the covering and cladding members so as to allow a reliable attachment of these to the frame member and vice versa.

The insulating abutment lists 430*a*, 430*b* shown in FIGS. 3-5 are attached to the side frame members 8, 12 by means of screws 431, but other ways of attachment may in principle also be used. As an example the abutment strip may be glued to the main body of the side frame member 8, 12.

The insulating abutment lists 430*a*, 430*b* each comprise a recess 432*a*, 432*b* conforming in shape with the respective part 19, 20 of the pivot hinge 200 connecting the stationary frame 2 and the sash frame 3. This enables the insulating abutment list 430 to be mounted adjacent to possibly even abutting the pivot hinge. Due care should of course be taken to allow the intended movement of the hinge parts and the two frames in relation to each other.

Preferably, the insulating abutment list is made of expanded polystyrene (EPS) or extruded polystyrene (XPS) but may in principle be made of any suitable insulating material including any other type of styrene or polystyrene.

Prior art windows having no insulating abutment list 430 are provided with a sash frame 3 and/or stationary frame 2 having a wooden part or element corresponding to the insulating abutment list 430. Providing the window 1 with insulating abutment lists 430 in lieu of the wooden part or element provides for a close fit and improved sealing of the gap between stationary frame 2 and sash frame 3 in the closed position of the window 1. In addition, a frame 2, 3 build in this way has a smaller thermal conductivity and thus improved heat transfer properties. Thereby the provision of insulating abutment lists 430 provides for a window 1 having a smaller overall heat transfer coefficient, also known as U value or U factor.

The use of insulating abutment lists may be combined with the use of insulating materials at other positions in the window structure and/or with arranging the window in one or more insulating frames as described for example in EP1 061199. An example of such a combination of insulating materials is shown in FIG. 5, where the side member 8 of the stationary frame 2 is provided with an insulating abutment list 430*a*, where the stationary frame 2 includes a strip 81 of an insulating material and where the window 1 is mounted in an insulating frame 82. Here the insulating frame 82 covers only the lowermost corner of the stationary frame, but it is to be understood that it may cover a larger part of the frame and that two or more such insulating frames may be used in combination. Likewise the strip 81 of insulating material may be at a different position and/or of a different shape and/or be enveloped by the frame material, thus forming a core in the frame member.

The above embodiment is particularly preferred in case of a wooden window. In case of a PUR-window the insulating abutment list 430 and the side frame member 7, 8, 11, 12 may be made as a one piece integral side frame member, the insulating material of the insulating abutment list being attached to the wooden reinforcement typically used in such frames before moulding.

Depending on the type of window, it is furthermore possible to provide an insulating abutment list similar to the insulating abutment lists 430*a*, 430*b* described above, but attached to and covering substantially at least the half of the side sash frame member 11 nearest the top sash frame member 9 and vice versa for the stationary frame. Likewise, insulating abutment lists may be used in combination with traditional wooden or integrated abutment lists.

Figure 6:
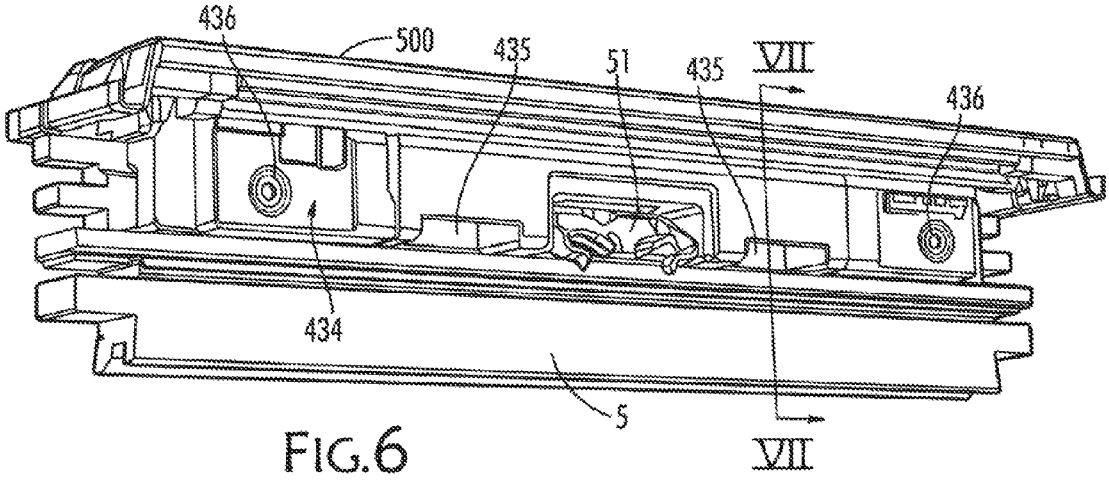
FIG. 6 shows a perspective view of the bottom ember of the stationary frame with insulation, strike plate and covering.
Figure 7:
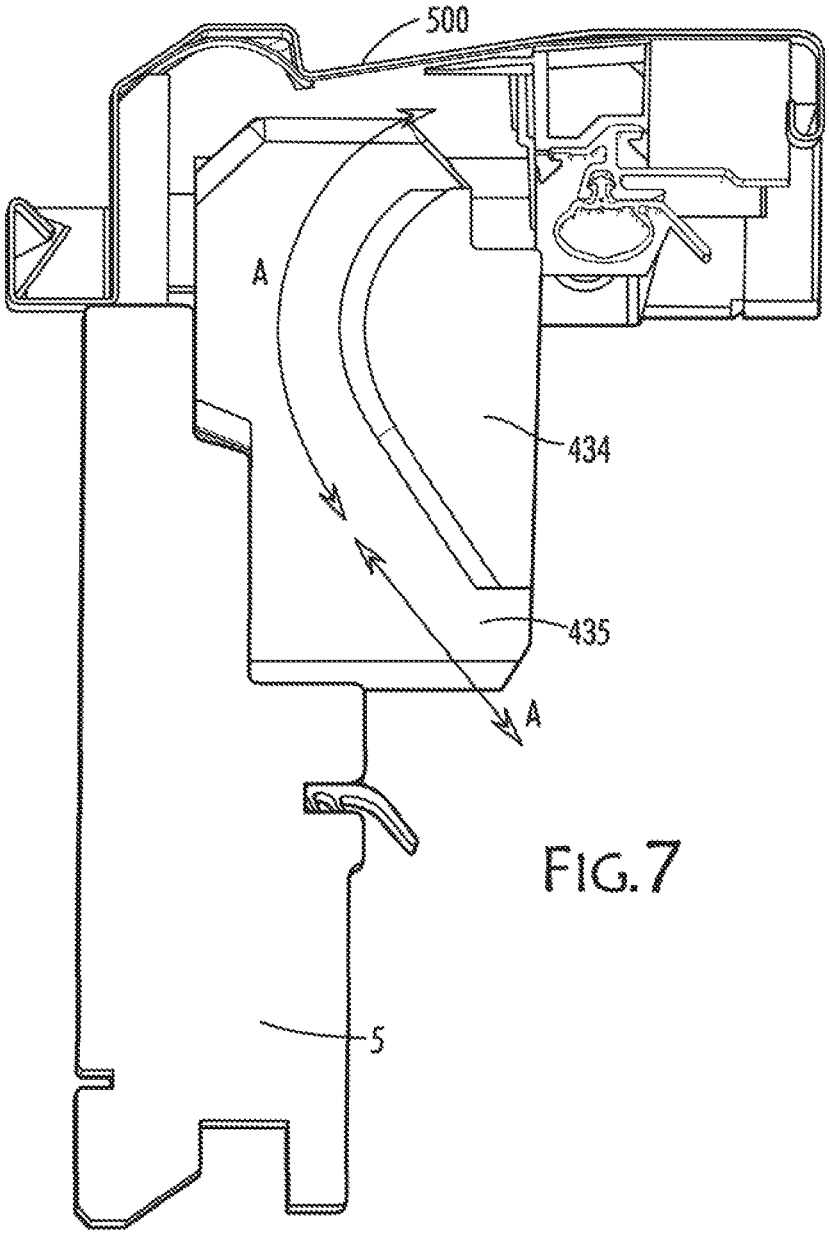
FIG. 7 shows a cross-section along the line VII-VII in FIG. 6, and FIGS. 8 and 9 correspond to FIGS. 1 and 2 showing a roof window according to the invention in from two different angles.

FIGS. 6 and 7 show an example of an insulating abutment list 434 on the top member 8 of the stationary frame 2. As may be seen the insulating abutment list is profiled to give room for a strike plate 51 and the associated locking assembly 17 on the sash frame 3. This insulating abutment list is furthermore provided with ventilation passages 435 allowing an air-exchange between the interior of a building and the space underneath the top frame covering 500 as indicated by the arrows A in FIG. 7.

Still referring to FIG. 6 the insulating abutment list 434 is fastened to the top frame member 5 by means of plastic screws having relatively large heads. This of course minimizes thermal bridging and the risk of the screw heads damaging the insulating material, but more importantly it makes dismantling very easy for users of the window wishing to install accessories such as an awning or blinds. It is even possible to provide the screws with lugs or slots allowing them to be taken out without the use of a screwdriver or like tool, for example by hand or simply using a flat object such as a coin.

Figure 8:
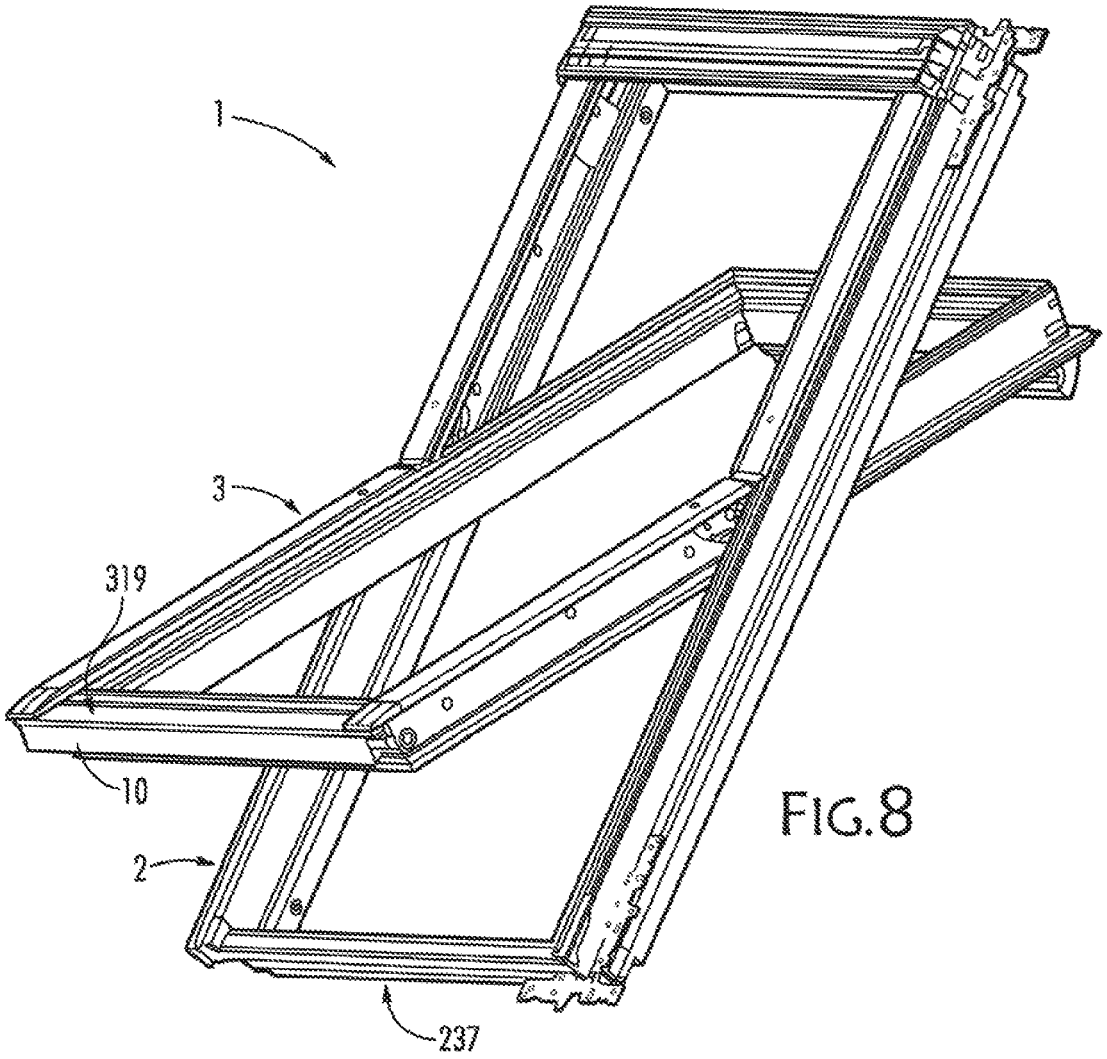
Figure 9:
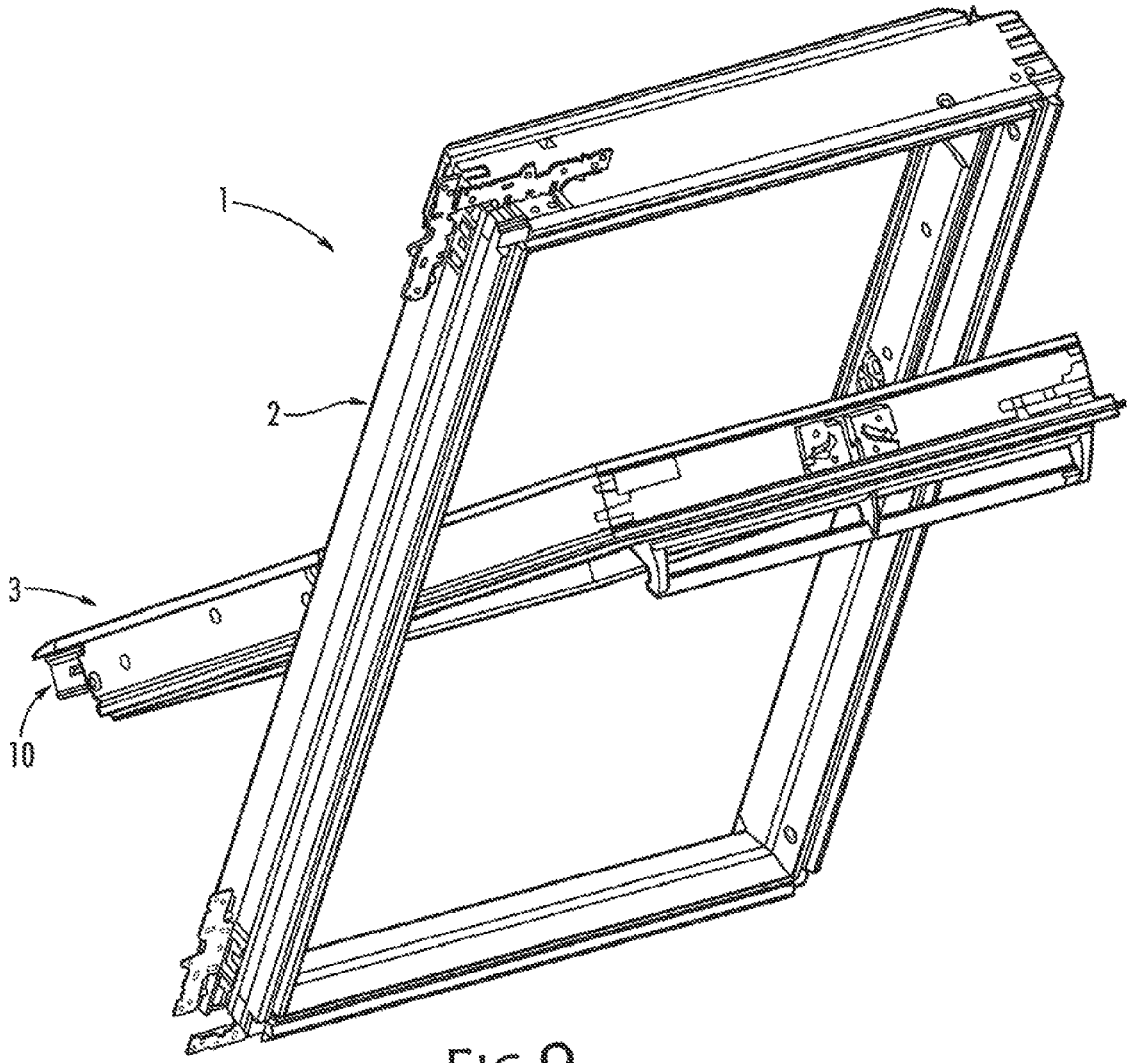

A window according to the invention is shown in an open state from two different angles in FIGS. 8 and 9.

In this a few embodiments of a roof window 1 with insulating abutment lists 430*a*, 430*b*. 434 has been shown and described but it is to be understood that insulating abutment lists may also be used on other windows and that their shape and design may be varied accordingly. Likewise, different combinations of features mentioned as alternatives above are also covered by the invention as defined by the scope of the claims.

The invention claimed is:

1. A first frame of a window for positioning adjacent to a second frame of the window, the first frame comprising:

a top member and a bottom member and first and second side members, each such member having an outboard surface configured to face a corresponding outboard surface of the second frame of the window, at least one of the top, bottom and side members including a sealing strip, at least one of the top, bottom and side members further including an insulating abutment list on the outboard surface configured to face an outboard surface of the second frame of the window, the insulating abutment list being made from a material having a thermal conductivity of less than 0.08 W/(m·K), and hinge parts attached to the two side members to define therebetween a hinge axis, the hinge axis residing substantially parallel to the top member and the bottom member, and wherein the insulating abutment list substantially covers the side surfaces extending from the hinge axis to either the bottom or top member, and the first frame configured as a stationary frame or as a sash frame.

2. A first frame according to claim 1, wherein the insulating abutment list is made from a material having a thermal conductivity of less than 0.04 W/(m·K).

3. A first frame according to claim 1, wherein the insulating abutment list is made from a plastic material.

4. A first frame according to claim 1, wherein the insulating abutment list is made from expanded polystyrene.

5. A first frame according to claim 1, wherein the insulating abutment list is made from extruded polystyrene.

6. A frame accordingly to claim 1, wherein the insulating abutment list entirely covers the side surfaces extending from the hinge axis to either the bottom or top member.

7. A frame according to claim 1, defining recesses in the insulating abutment list at ends nearest to the hinge parts, the recesses conforming in shape to the shape of the hinge parts.

8. A frame according to claim 1, wherein the top, bottom, and side members are made from wood and wherein the insulating abutment list is attached using screws, glue, or an adhesive.

9. A frame according to claim 1, wherein the frame is configured in a window as a stationary frame.

10. A frame according to claim 9, wherein the stationary frame comprises at least one insulating abutment list on an inner surface facing a sash frame and extending from a hinge part to the top member of the stationary frame.

11. A frame according to claim 1, wherein the frame is configured in a window as a sash frame.

12. A window according to claim 11, wherein the sash frame comprises at least one insulating abutment list on an outer surface facing a stationary frame and extending from a hinge part to the bottom member of the sash frame.

13. A method for making a frame for a window comprising the steps of providing an insulating abutment list, a sealing strip, and a frame main body, the frame lain body configured as a stationary frame or as a sash frame; and attaching the insulating abutment list and the sealing strip to the frame main body at a top, bottom, or side members of the main body, the frame main body having an outboard surface configured to face a corresponding outboard surface of a frame secondary body of a window, wherein the insulating abutment list is on the outboard surface of the frame main body and configured to face the corresponding outboard surface of the frame secondary body of the window, the abutment list made from a different material than the main body and the sealing strip, the different material having a thermal conductivity of less than 0.08 W/(m·K), the frame main body further having hinge parts attached to the two side members to define therebetween a hinge axis, the hinge axis residing substantially parallel to the top member and the bottom member, and wherein the insulating abutment list substantially covers the side surfaces extending from the hinge axis to either the bottom or top member.

14. The method of claim 13, wherein the insulating abutment list is permanently attached to the frame main body.

15. The method of claim 13, wherein the insulating abutment list is detachably attached to the frame main body.

16. The method of claim 13, wherein at least one main body of a frame member is made from wood and wherein at the least one insulating abutment list attached thereto is made from expanded polystyrene or extruded polystyrene.

* * * * *